US008911073B2

(12) United States Patent
Ohnishi

(10) Patent No.: US 8,911,073 B2
(45) Date of Patent: Dec. 16, 2014

(54) PRINTING METHOD AND PRINTING SYSTEM

(71) Applicant: Mimaki Engineering Co., Ltd., Tomi (JP)

(72) Inventor: Masaru Ohnishi, Tomi (JP)

(73) Assignee: Mimaki Engineering Co., Ltd., Tomi (JP)

( * ) Notice: Subject to any disclaimer, the term of this patent is extended or adjusted under 35 U.S.C. 154(b) by 0 days.

(21) Appl. No.: 14/029,799

(22) Filed: Sep. 18, 2013

(65) Prior Publication Data

US 2014/0015908 A1 Jan. 16, 2014

Related U.S. Application Data

(63) Continuation of application No. PCT/JP2011/080496, filed on Dec. 28, 2011.

(30) Foreign Application Priority Data

Mar. 29, 2011 (JP) ..... 2011-072482

(51) Int. Cl.

| | |
|---|---|
| ***B41J 2/01*** | (2006.01) |
| ***B05D 3/06*** | (2006.01) |
| ***B41J 2/005*** | (2006.01) |
| ***B41M 5/035*** | (2006.01) |
| ***B41M 7/00*** | (2006.01) |
| ***B41M 5/025*** | (2006.01) |
| ***B41M 1/40*** | (2006.01) |
| ***B41M 5/03*** | (2006.01) |
| ***B05D 1/28*** | (2006.01) |

(52) U.S. Cl.

CPC ..... *B05D 3/067* (2013.01); *B41J 2/0057* (2013.01); *B41M 5/035* (2013.01); *B41M 7/0081* (2013.01); *B41M 5/0256* (2013.01); *B41M 1/40* (2013.01); *B41M 5/03* (2013.01); *B05D 1/28* (2013.01)

USPC ..... 347/102

(58) Field of Classification Search

USPC ..... 347/100, 102, 103, 171, 213, 215, 217

See application file for complete search history.

(56) References Cited

U.S. PATENT DOCUMENTS

2009/0207198 A1 8/2009 Muraoka

FOREIGN PATENT DOCUMENTS

| | | |
|---|---|---|
| JP | 06-008697 | 1/1994 |
| JP | 10-202998 | 8/1998 |
| JP | 2004-359761 | 12/2004 |
| JP | 2006-130725 | 5/2006 |
| JP | 2007-331794 | 12/2007 |
| JP | 2010-143073 | 7/2010 |
| JP | 2011-016298 | 1/2011 |

OTHER PUBLICATIONS

International Search Report for corresponding International Application No. PCT/JP2011/080496, Mar. 6, 2012.

*Primary Examiner* — Kristal Feggins

(74) *Attorney, Agent, or Firm* — Mori & Ward, LLP

(57) ABSTRACT

A printing method includes applying a curable resin-containing ink onto an inked surface of a transfer sheet, heating the ink applied on the inked surface of the transfer sheet to increase viscosity of the ink, transferring the heated ink on the inked surface of transfer sheet to a printing object directly or indirectly, and curing the ink transferred to the printing object.

15 Claims, 3 Drawing Sheets

PRINTING METHOD AND PRINTING SYSTEM

CROSS-REFERENCE TO RELATED APPLICATIONS

The present application is a continuation application of International Application No. PCT/JP2011/080496, filed Dec. 28, 2011, which claims priority to Japanese Patent Application No. 2011-072482, filed Mar. 29, 2011. The contents of these applications are incorporated herein by reference in their entirety.

BACKGROUND OF THE INVENTION

1. Field of the Invention

The present invention relates to a printing method and a printing system.

2. Discussion of the Background

JP-A-2006-130725 (published May 25, 2006) discloses an offset printing method based on inkjet printing. The method described in JP-A-2006-130725 includes a first step of printing a UV ink image on a flat original sheet by inkjet printing using a UV ink, a second step of bringing the UV ink image to a semi-dry state by irradiation of ultraviolet light or an electron beam while printing the UV ink image or immediately after the printing, a third step of transferring the semi-dry UV ink image to an elastic blanket surface, a fourth step of offset printing a printing object with the UV ink image transferred to the elastic blanket, and a step of drying and fusing the UV ink image formed by offset printing.

SUMMARY OF THE INVENTION

According to one aspect of the present invention, a printing method includes applying a curable resin-containing ink onto an inked surface of a transfer sheet, heating the ink applied on the inked surface of the transfer sheet to increase viscosity of the ink, transferring the heated ink on the inked surface of transfer sheet to a printing object directly or indirectly, and curing the ink transferred to the printing object.

According to another aspect of the present invention, a printing system includes an applying device to apply a curable resin-containing ink onto an inked surface of a transfer sheet, a heating device to heat the ink applied on the inked surface of the transfer sheet to increase viscosity of the ink, a transferring device to transfer the heated ink on the inked surface of transfer sheet to a printing object directly or indirectly, and a curing device to cure the ink transferred to the printing object.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1A:
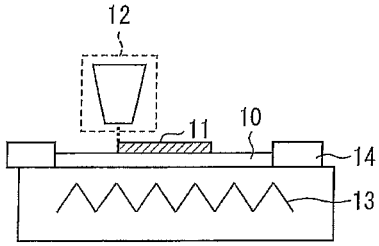
FIGS. 1A to 1E are diagrams schematically representing a printing method according to an embodiment of the present invention.

The embodiments will now be described with reference to the accompanying drawings, wherein like reference numerals designate corresponding or identical elements throughout the various drawings.

In the embodiments of the present invention, the original sheet (transfer sheet) is heated to bring the printing image (ink) on the original sheet to a dry state. The ink is heated to dry according to the embodiments of the present invention.

The mechanism by which the UV ink is semi-cured by the UV irradiation to achieve the semi-dry state is the crosslinking (resinifying) of the monomer. On the other hand, the mechanism of heating of the original sheet involves evaporation of components other than the curable resin (for example, such as a solvent), and/or curing of the curable resin itself under heat. This is advantageous in terms of uniformity, because the contents of components other than the curable resin (such as a solvent) will not be greatly different between the printed portions that are higher and lower in the order of printing. Accordingly, the efficiency of removing components other than the curable resin (such as a solvent) due to drying, and/or the extent of the heat curing of the curable resin itself tend to be uniform in the printed portions that are higher and lower in the order of printing, and the transfer characteristics become less inconsistent. This makes it possible to enable stable and high-quality printing in multi-pass printing (for example, pad printing) that uses an ink containing a curable resin such as a UV ink.

As used herein, "curable resin" refers to resins that cure under external stimulation. Examples include ultraviolet curable resin that cures by ultraviolet irradiation (hereinafter, "UV" is also used to refer to "ultraviolet light"), electron beam curable resin that cures by electron beam irradiation, heat curable resin that cures under heat (such as a latex), and heat drying curable resin that cures by being dried (such as a solvent ink). When using a latex ink, a solvent ink, and the like, drying or other intended effects can be achieved by heating in both the heating step and the curing step (described later).

Examples of the curable resin-containing ink include inks that contain a curable resin and a solvent. For example, in the case of an ink that contains a UV curable resin and a solvent, drying the ink by evaporating the solvent in the heating step leaves the UV curable resin and makes the ink more viscous, and the ink can be cured by curing the UV curable resin by irradiating the ink with UV light in the curing step. In this manner, the ink containing a curable resin and a solvent can be used to easily perform the heating step and the curing step.

The UV curable resin may be a cation polymerizable resin, a radical polymerizable resin, or a mixture of these. The UV curable resin may be selected according to the intended viscosity. For example, both low-viscosity monomers and oligomers and high-viscosity monomers and oligomers may be used. Specifically, a viscosity of 30 to 100,000 mPa·sec, preferably 100 to 1,000 mPa·sec is used.

The solvent may be appropriately selected, for example, according to the type of the curable resin used. For example, the solvent may be at least one selected from the group consisting of glycol ether solvents (such as propylene glycol methyl ether acetate, and propylene glycol methyl ether), γ-butyrolactone, and cyclohexanone.

The specific method used for the application step may be any method that applies the ink onto the transfer sheet, and, for example, an inkjet method may be used.

The ink may have a viscosity suited for intended use, preferably 3 mPa·sec or more and 20 mPa·sec or less at 25° C. before the heating step. This makes it easier to eject the ink through an inkjet head.

The heating step increases the viscosity to preferably 30 mPa·sec or more and 10,000 mPa·sec or less. This viscosity range is preferable, because it makes the ink liquid- or paste like with a viscosity sufficiently high as to prevent bleeding of the ink, and provides adherence suited for transfer.

The specific method used for the heating step may be one, for example, that involves heating and drying of the ink to increase the ink viscosity through evaporation of the moisture contained in the curable resin.

In the printing method according to an embodiment of the present invention, the solvent content with respect to the total ink amount in the solvent-containing ink may be appropriately set according to intended use, and is preferably 20 weight % or more and 95 weight % or less. In this range, 80% of the solvent can be removed by drying, and the viscosity of the ink can be increased. The foregoing range is also preferable from the viewpoint of obtaining a glossy printed surface after the printing.

The ink is not limited to a specific color, and may have various colors, including, for example, ordinary colors such as Y (yellow), M (magenta), C (cyan), and K (black), specific colors such as pale, white, metallic, and clear varieties of these ordinary colors, and combinations of these colors.

Various types of transfer sheets may be used according to intended use, and the transfer sheet is preferably an elastic sheet that allows easy transfer when the printing object has a non-flat surface such as a curved surface, more preferably one that can deform along the shape of the printing surface of the printing object. The transfer sheet material may be, for example, silicon rubber. Other examples include rubbers (such as fluororubber, butyl rubber, chloroprene rubber, urethane rubber, butadiene rubber, neoprene, and EPDM), simple elastomer resin, and composite materials of these. These may be selected according to intended use. A transfer sheet made of these materials makes it easier to perform the transfer step, because it allows the inked surface of the transfer sheet to adhere to the printing object by being directly pressed against the printing object to be transferred.

When the transfer sheet is disposable, the transfer sheet may be a non-restoring transfer sheet that, unlike rubber, does not restore the original shape upon release of the pressure. Examples of such a non-restoring transfer sheet include a thin thermoplastic resin film such as a laminate film.

The hardness and the thickness of the transfer sheet may be appropriately changed according to the shape of the printing object. Preferably, the transfer sheet should be less hard and thinner as the shape of the printing object becomes more complex. When the printing object is a flat plate, the transfer sheet may have a form of a rubber plate.

Preferably, the transfer sheet is directly pressed against the printing object under the pressure of a pad applied to the surface opposite from the inked surface, because this makes it possible to transfer the ink under more evenly applied and uniform pressure.

When using a UV curable ink diluted with a solvent, the ink may be transferred from the transfer sheet to a bracket, and the bracket may be printed to the printing object. However, there are cases where the ink that has warmed on the transfer sheet cools after being transferred to the bracket, and the ink temperature decreases upon the ink being transferred from the bracket to the printing object. In other words, there are cases where the ink transfer temperature becomes different between the transfer to the bracket and the transfer to the printing object, and varies the transfer rate. Such a problem can preferably be avoided by directly transferring the ink from the transfer sheet to the printing object.

In the transfer step, the transfer from the transfer sheet to the printing object may be direct or indirect. However, direct transfer is more preferable for the reasons described above. As used herein, "direct transfer" means transferring the ink with the transfer sheet adhering to the printing object by being directly pressed against the printing object, whereas "indirect transfer" means transfer from the transfer sheet to some other object such as a bracket, and then from the other object to the printing object. More than one such other object may be used; however, it is more preferable to use fewer such objects from the viewpoint of transfer rate.

The transfer step may be performed at room temperature, or under intentionally adjusted temperatures, such as by retaining heat or by heating, to provide a constant-temperature transfer environment for more stable transfer conditions.

The transfer may be performed in order, color by color, or at once, for example, in two, four, or six colors.

The heating step performed before the transfer step involves a viscosity gradient because the drying of the ink proceeds from the ink surface. Specifically, the ink surface in contact with the transfer sheet has higher viscosity than the ink closer to the ink applied surface. The ink can thus be desirably transferred to the transfer sheet.

In the curing step, the ink may be cured by using a method appropriately selected according to the type of the ink used. For example, when the ink is a UV curable ink, the ink may be irradiated with UV down to the interior of the ink using a device such as a UV irradiator.

Embodiment 1

A printing method according to an embodiment of the present invention is described below with reference to FIGS. 1A to 1E. FIGS. 1A to 1E are diagrams that schematically represent the printing method according to the present embodiment.

The present embodiment will be described through the case where the ink is a UV curable ink that contains a UV curable resin diluted with a solvent.

As represented in FIG. 1A, a UV curable ink is applied onto a transfer sheet 10 of a material such as silicon rubber provided on a flat plate, using an inkjet head (applying means) 12 (application step). The transfer sheet 10 is attached to a holder 14 to maintain the sheet shape on the flat surface and to improve operability.

Then, the ink on the transfer sheet 10 is heated with a heater (heating means) 13 to evaporate the solvent and dry the ink (heating step). Here, in order to adjust viscosity, the solvent is evaporated to such an extent that the ink does not bleed and that the adherence sufficient to enable a transfer is maintained. As a result, a temporarily cured printing image 11 is formed on the transfer sheet 10. The term "temporary cure" is used to refer to evaporating the solvent and increasing the ink viscosity.

Various heating means can be used as the heater 13, including, for example, a ceramic heater, a tungsten heater, a sheathed wire heater, a far infrared heater, an IH heater, a fan heater, and a combination of these.

Heating by the heater 13 is performed, for example, at 40° C. to 70° C. for 5 seconds to 5 minutes, more preferably 1 minute or less.

In the present embodiment, the viscosity of the UV curable ink preferably ranges from 3 mPa·sec to 20 mPa·sec at room temperature for easy ejection through the head. The heating step using the heater 13 may increase the viscosity to, for example, 30 mPa·sec or more and 10,000 mPa·sec or less. In this range, the UV curable ink can exist in a liquid or a paste form with a viscosity sufficiently high as to prevent bleeding, and can have adherence suited for transfer.

Figure 1B:
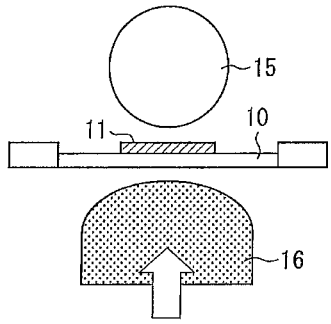

Then, as represented in FIG. 1B, the transfer sheet 10 is placed between a printing object 15 and a pad (transferring means) 16. In the present embodiment, the printing object 15 is spherical. However, the shape of the printing object subject to printing by the printing method according to an embodiment of the present invention is not limited to this, and printing objects of various shapes can be used for printing.

Figure 1C:
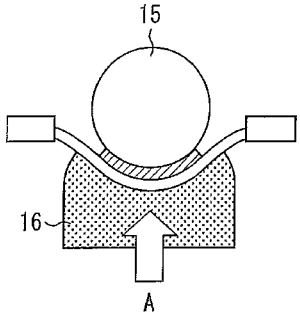

Thereafter, as represented in FIG. 1C, the pad 16 is pressed in the direction of arrow A to press the transfer sheet 10 against the printing surface of the printing object 15 on the surface having the temporarily cured printing image 11. As a result, the temporarily cured printing image 11 is transferred onto the printing object 15 (transfer step).

The exerted pressure also planarizes the temporarily cured printing image 11. This makes it possible to overcome the drawback of inkjet printing using UV curable ink, specifically the matting problem of producing a lusterless surface, and a high glossy ink image can be obtained. The surface of the transfer sheet 10 may be matted when the matte texture needs to be maintained.

The pad is preferably made of elastic material, preferably materials that can uniformly exert pressure to the object. For example, the pad material may be a soft rubber, a hard rubber, a sponge, or a bag containing liquid, powder, or gas. When the transfer sheet is planar as in Embodiment 3 (described later), the pad may be made of metal, pursuit, wood, or a felt.

Figure 1D:
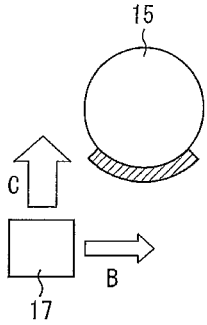

Then, as represented in FIG. 1D, the temporarily cured printing image 11 on the printing object 15 is irradiated with ultraviolet light in the direction of arrow C using a UV irradiator (curing means) 17 while moving the UV irradiator 17 in the direction of arrow B. The UV irradiation wholly cures the temporarily cured printing image 11 on the printing object 15 (curing step). Note that the term "final cure" is also used to distinguish the curing in the curing step from the viscosity increase in the heating step.

Examples of specific configurations of the UV irradiator 17 include a UV-LED lamp, a metal halide lamp, a black light, a germicidal lamp, a xenon lamp, and a combination of these. The UV wavelength may be, for example, from 350 nm to 410 nm.

Figure 1E:
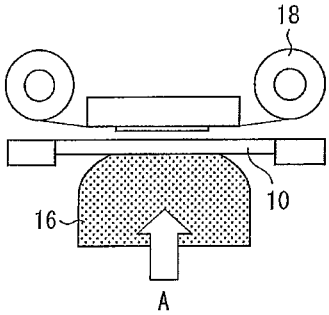

For further printing, as represented in FIG. 1E, a cleaning sheet 18 is used to clean the transfer sheet 10. For example, the transfer sheet 10 is cleaned by wiping any remaining ink and adhered dust from the transfer sheet 10 with the cleaning sheet 18 being slid under the exerted pressure of the pad 16 in the direction of arrow A. The transfer sheet 10 and the pad 16 may be washed with alcohol and the like.

The present embodiment advantageously controls the transfer rate with ease. When using a UV curable ink diluted with a solvent as above, it is possible to use a method in which the ink is transferred from the transfer sheet to the bracket, and then to the printing object. However, there are cases where the ink that has warmed on the transfer sheet cools after being transferred to the bracket, and the ink temperature decreases upon the ink being transferred from the bracket to the printing object. Such a temperature decrease of the ink can preferably be suppressed by directly transferring the ink from the transfer sheet to the printing object as in the present embodiment.

In the present embodiment, fabrication of a printing plate is not necessary, and small-quantity and wide-variety curved surface printing can be performed at low cost in a short time period. Further, because the transfer is performed only once, bleeding due to color shift and color transfer can be reduced more than in conventional pad printing in which the transfer occurs twice (indirect transfer from the transfer sheet to the printing object).

Embodiment 2

The printing method according to an embodiment of the present invention is described below with reference to FIGS. 2A to 2E. For convenience of explanation, functionally equivalent members already described in Embodiment 1 with reference to the appended figures will be referred to by the same reference numerals, and explanations thereof will be omitted. The following description of the present embodiment deals primarily with differences from Embodiment 1.

Figure 2A:
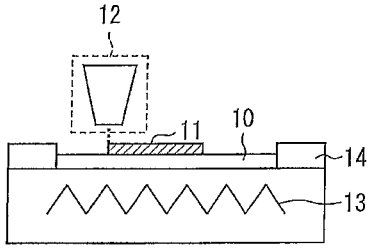
FIGS. 2A to 2E are diagrams schematically representing a printing method according to another embodiment of the present invention.

First, as represented in FIG. 2A, an inkjet head 12 is used to apply the UV curable ink onto the transfer sheet 10 planarly fixed with the holder 14 (application step).

The ink on the transfer sheet 10 is then heated with the heater 13 to evaporate the solvent and dry the ink (heating step). As a result, the temporarily cured printing image 11 is formed on the transfer sheet 10.

Figure 2B:
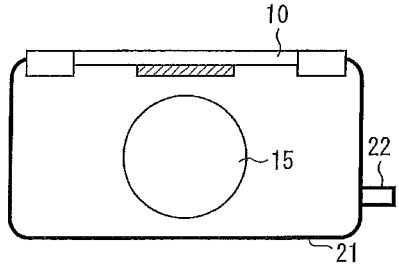

Then, as represented in FIG. 2B, the printing object 15 is placed in a vacuum chamber (casing) 21. The opening of the vacuum chamber 21 is then covered with the transfer sheet 10 after adjusting the orientation of the transfer sheet 10 in a manner that positions the temporarily cured printing image 11 inside of the vacuum chamber 21. Specifically, the holder 14 is set at the edge of the opening. This seals the vacuum chamber 21. The vacuum chamber 21 has an outlet 22.

Figure 2C:
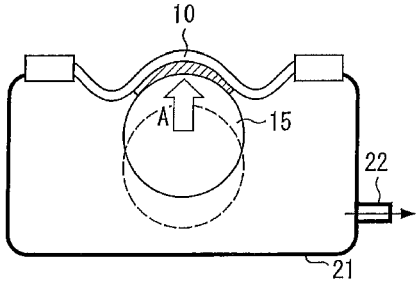

Thereafter, as represented in FIG. 2C, the air inside the vacuum chamber 21 is released from the outlet 22 to reduce the pressure inside the vacuum chamber 21. As a result, the transfer sheet 10 bends inwardly into the vacuum chamber. On the other hand, the printing object 15 moves along the direction of arrow A, and adheres to the transfer sheet 10. As a result, the temporarily cured printing image 11 is transferred onto the printing object 15 (transfer step). Alternatively, the shape of the vacuum chamber 21 may be adjusted to allow the transfer sheet 10 to be naturally pressed against and adhere to the printing object 15 under the air pressure externally exerted to the transfer sheet 10 from outside of the vacuum chamber 21.

Figure 2D:
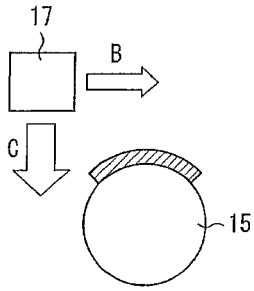

Then, as represented in FIG. 2D, the temporarily cured printing image 11 on the printing object 15 is irradiated with ultraviolet light in the direction of arrow C using the UV irradiator 17 while moving the UV irradiator 17 in the direction of arrow B. The UV irradiation wholly cures the temporarily cured printing image 11 on the printing object 15 (curing step).

Figure 2E:
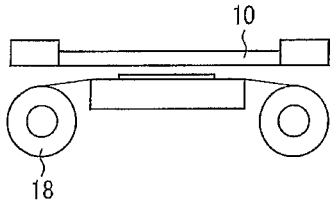

For further printing, as represented in FIG. 2E, the cleaning sheet 18 is used to clean the transfer sheet 10.

The present embodiment advantageously controls the transfer rate with ease as in Embodiment 1.

Further, in the present embodiment, fabrication of a printing plate is not necessary, and small-quantity and wide-variety curved surface printing can be performed at low cost in a short time period. Further, because the transfer is performed only once, bleeding due to color shift and color transfer can be reduced more than in conventional pad printing in which the transfer occurs twice (indirect transfer from the transfer sheet to the printing object).

Further, the present embodiment enables direct transfer from the transfer sheet to the printing object, without using a pad. This makes it possible to easily transfer the ink to a large-area object having large irregularities, because more uniform pressure can be applied with the use of atmospheric pressure.

Embodiment 3

The printing method according to an embodiment of the present invention is described below with reference to FIGS. 3A to 3E. For convenience of explanation, functionally equivalent members already described in Embodiment 1 with reference to the appended figures will be referred to by the same reference numerals, and explanations thereof will be omitted. The following description of the present embodiment deals primarily with differences from Embodiment 1.

The present embodiment differs from Embodiments 1 and 2 in that the transfer from the transfer sheet 30 to the printing object 15 is indirect. That is, the ink is transferred from the transfer sheet 30 to the pad 16, and then from the pad 16 to the printing object 15.

Figure 3A:
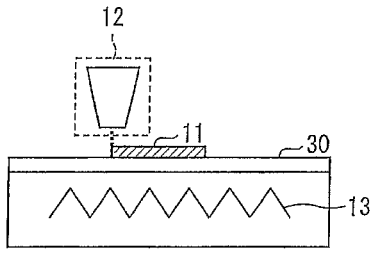
FIGS. 3A to 3E are diagrams schematically representing a printing method according to yet another embodiment of the present invention.

First, as represented in FIG. 3A, the UV curable ink is applied onto a planar transfer sheet 30 using the inkjet head 12 (application step). Unlike the transfer sheet 10 of Embodiments 1 and 2, the transfer sheet 30 is planar, and by being inelastic, cannot deform according to the shape of the printing object.

Then, the ink on the transfer sheet 30 is heated with the heater 13 to evaporate the solvent and dry the ink (heating step). As a result, the temporarily cured printing image 11 is formed on the transfer sheet 30.

Figure 3B:
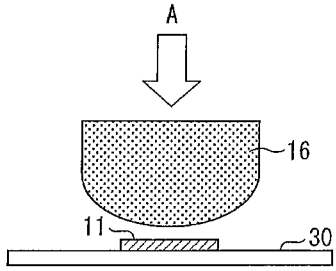
Figure 3C:
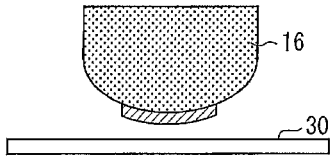

Thereafter, as represented in FIG. 3B, the pad 16 is moved in the direction of arrow A and pressed against the temporarily cured printing image 11 on the transfer sheet 30. As a result, the temporarily cured printing image 11 is transferred onto the pad 16. FIG. 3C represents the state after this first transfer.

Figure 3D:
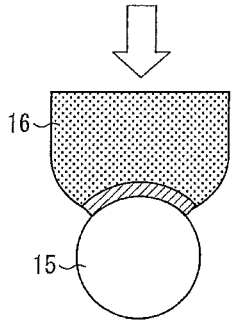

Then, as represented in FIG. 3D, the pad 16 is pressed against the printing object 15 in contact therewith to transfer the temporarily cured printing image 11 to the printing object 15 under pressure. Note that heat may be applied before or after the transfer to the pad 16, in order to improve the adhesion between the printing object 15 and the pad 16.

Figure 3E:
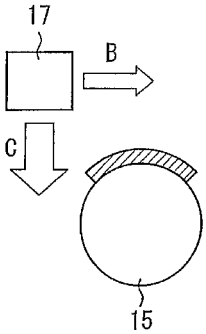

Finally, as represented in FIG. 3E, the temporarily cured printing image 11 on the printing object 15 is irradiated with ultraviolet light in the direction of arrow C using the UV irradiator 17 while moving the UV irradiator 17 in the direction of arrow B. The UV irradiation wholly cures the temporarily cured printing image 11 on the printing object 15 (curing step).

[Printing System]

A printing system according to the present invention includes applying means for applying a curable resin-containing ink to a transfer sheet, heating means for drying the ink on the transfer sheet to increase the viscosity of the ink, transferring means for directly or indirectly transferring the ink on the transfer sheet onto a printing object, and curing means for curing the ink on the printing object.

The inkjet head 12, the heater 13, the pad 16, and the UV irradiator 17 of Embodiment 1 embody the applying means, the heating means, the transferring means, and the curing means, respectively. That is, the printing system according to an embodiment of the present invention is in accordance with the descriptions of Embodiment 1 and FIGS. 1A to 1E.

<Other Remarks>

As described above, the printing method according to an embodiment of the present invention includes an application step of applying a UV curable resin-containing ink onto the transfer sheet 10, a heating step of heating the ink on the transfer sheet 10 to increase the viscosity of the ink, a transfer step of directly transferring the ink on the transfer sheet 10 onto the printing object 15, and a curing step of curing the ink on the printing object 15. This enables stable and high-quality printing in multi-pass offset printing that uses a UV ink and the like.

Further, because the UV curable ink is an ink that contains a solvent, the ink viscosity can be increased upon drying the ink and evaporating the solvent.

The UV curable ink has a viscosity of preferably 3 mPa·sec or more and 20 mPa·sec or less at 25° C. before the heating step. In this way, the ink can be desirably applied onto the printing object 15 in the application step without bleeding.

It is preferable that the heating step evaporate the solvent in the UV curable ink to dry the ink. In this way, the viscosity of the ink can easily be increased in the heating step.

It is preferable that the solvent be at least one selected from the group consisting of propylene glycol methyl ether acetate, propylene glycol methyl ether, γ-butyrolactone, and propylene glycol monomethyl ether acetate. In this way, the solvent can more efficiently evaporate.

Further, because the UV curable ink can be cured by being irradiated with ultraviolet light in the curing step, the curing step can easily be performed by simple irradiation of ultraviolet light.

It is preferable that the transfer step transfer the ink by directly pressing the inked surface of the transfer sheet 10 against the printing object 15. The transfer rate can easily be controlled in this embodiment. Further, fabrication of a printing plate is not necessary, and small-quantity and wide-variety curved surface printing can be performed at low cost in a short time period. Further, because the transfer is performed only once, bleeding due to color shift and color transfer can be reduced more than in pad printing in which the transfer occurs twice. It is also preferable that the transfer sheet 10 be pressed under the pressure of the pad 16 applied to a surface opposite from the inked surface. More efficient transfer is possible under the pressure of the pad 16.

It is preferable that the transfer sheet 10 be deformable along the shape of a printing surface of the printing object 15. In this way, the printing object can be selected from a wide variety of shapes.

It is preferable that the transfer sheet 10 be a silicon rubber. In this way, the printing object 15 can be selected from a wide variety of shapes.

It is preferable that the pad 16 have elasticity. In this way, the printing object can be selected from a wide variety of shapes.

The transfer sheet 10 may have elasticity, and the transfer step may transfer the ink after the transfer sheet 10 subjected to the heating step is placed in the vacuum chamber 21 having the outlet 22, or after covering an opening of the vacuum chamber 21 by installing the transfer sheet 10 in the opening when the vacuum chamber 21 has an opening other than the outlet 22, the ink being transferred to the printing object 15 housed inside the vacuum chamber 21 in advance from the transfer sheet 10 adhering to the printing object 15 under the reduced pressure created inside the vacuum chamber 21 by sucking air out of the vacuum chamber 21 through the outlet 22. In this way, the transfer rate can easily be controlled. Further, fabrication of a printing plate is not necessary, and small-quantity and wide-variety curved surface printing can be performed at low cost in a short time period. Further, because the transfer is performed only once, bleeding due to color shift and color transfer can be reduced more than in pad printing in which the transfer occurs twice. Further, the ink can be directly transferred from the transfer sheet 10 to the printing object 15, without using the pad 16 used in Embodiment 1. It is also possible to easily transfer the ink to a large-area object having large irregularities, because more uniform pressure can be applied with the use of atmospheric pressure.

The transfer step may indirectly transfer the ink from the transfer sheet 10 to the printing object 15 by transferring the ink to the pad 16 being pressed against the transfer sheet 10 subjected to the heating step and then to the printing object 15 from the pad 16 being pressed against the printing object 15. Because the ink is transferred to the printing object 15 via the pad 16, stable and high-quality printing can be realized in multi-pass offset printing.

The printing system according to an embodiment of the present invention includes the inkjet head 12, the heater 13, the pad 16, and the UV irradiator 17. In this way, stable and high-quality printing can be realized in multi-pass offset printing that uses a UV curable ink.

Obviously, numerous modifications and variations of the present invention are possible in light of the above teachings. It is therefore to be understood that within the scope of the appended claims, the invention may be practiced otherwise than as specifically described herein.

What is claimed is:

1. A printing method comprising:

applying a curable resin-containing ink onto an inked surface of a transfer sheet;

heating the ink applied on the inked surface of the transfer sheet to increase viscosity of the ink;

transferring the heated ink on the inked surface of the transfer sheet to a printing object directly or indirectly; and curing the ink transferred to the printing object, wherein the ink has a viscosity of 3 mPa·sec or more and 20 mPa·sec or less at 25° C. before being heated.

2. The printing method according to claim 1, wherein the curable resin-containing ink contains a curable resin and a solvent.

3. The printing method according to claim 2, wherein the solvent in the ink evaporates by heating.

4. The printing method according to claim 2, wherein the solvent comprises at least one of propylene glycol methyl ether acetate, propylene glycol methyl ether, γ-butyrolactone, and propylene glycol monomethyl ether acetate.

5. The printing method according to claim 1, wherein the curable resin-containing ink comprises an ultraviolet light curable resin, and wherein the curable resin-containing ink is irradiates with ultraviolet light to cure the ink.

6. The printing method according to claim 1, wherein the inked surface of the transfer sheet is directly pressed against the printing object to transfer the ink from the inked surface to the printing object.

7. The printing method according to claim 6, wherein a pad is pressed against a surface opposite to the inked surface to press the inked surface of the transfer sheet against the printing object.

8. The printing method according to claim 7, wherein the pad has elasticity.

9. The printing method according to claim 6, wherein the transfer sheet is deformable corresponding to a shape of a printing surface of the printing object.

10. The printing method according to claim 9, wherein the transfer sheet comprises a silicon rubber.

11. The printing method according to claim 1, wherein the transfer sheet has elasticity, and the heated ink on the inked surface of transfer sheet is transferred to a printing object after the transfer sheet which has been heated is provided in a casing having an outlet, or after covering an opening of the casing by installing the transfer sheet in the opening in a case where the casing has an opening in addition to the outlet, the ink being transferred to the printing object housed inside the casing in advance from the transfer sheet adhering to the printing object under reduced pressure created inside the casing by sucking air out of the casing through the outlet.

12. The printing method according to claim 1, wherein the curable resin-containing ink is an ultraviolet curable ink with solvent, wherein the heating of the ink applied on the inked surface of the transfer sheet evaporates the solvent and dries the curable resin-containing ink to form a temporarily cured printing image, wherein the transferring of the heated ink on the inked surface of the transfer sheet to the printing object includes:

transferring the temporarily cured printing image on the inked surface of the transfer surface onto a pad; and pressing the pad to the printing object to transfer the temporarily cured printing image from the pad to the printing object, and wherein curing the ink includes irradiating the temporarily cured printing image transferred on the printing object to cure the temporarily cured printing image.

13. A printing method comprising:

applying a curable resin-containing ink onto an inked surface of a transfer sheet;

heating the ink applied on the inked surface of the transfer sheet to increase viscosity of the ink;

transferring the heated ink on the inked surface of the transfer sheet to a printing object; and curing the ink transferred to the printing object, wherein the ink is indirectly transferred from the transfer sheet to the printing object by transferring the ink to a pad being pressed against the heated transfer sheet and then to the printing object from the pad being pressed against the printing object.

14. A printing system comprising:

applying means for applying a curable resin-containing ink onto an inked surface of a transfer sheet;

heating means for heating the ink applied on the inked surface of the transfer sheet to increase viscosity of the ink;

transferring means for transferring the heated ink on the inked surface of transfer sheet to a printing object indirectly, the transferring means including a pad configured to press against and receive the heated ink from the inked surface of the transfer sheet, the pad being further configured to press against and transfer the heated ink to the printing object; and curing means for curing the ink transferred to the printing object.

15. A printing system comprising:

an applying device to apply a curable resin-containing ink onto an inked surface of a transfer sheet;

a heating device to heat the ink applied on the inked surface of the transfer sheet to increase viscosity of the ink;

a transferring device to transfer the heated ink on the inked surface of transfer sheet to a printing object indirectly, the transferring device including a pad configured to press against and receive the heated ink from the inked surface of the transfer sheet, the pad being further configured to press against and transfer the heated ink to the printing object; and a curing device to cure the ink transferred to the printing object.

* * * * *